US011453842B2

(12) United States Patent
Piorkowski

(10) Patent No.: US 11,453,842 B2
(45) Date of Patent: Sep. 27, 2022

(54) USE OF FILLER BLEND TO REDUCE TURBIDITY AND DISCOLORATION OF UNIT DOSE DETERGENT COMPOSITION

(71) Applicant: Henkel AG & Co. KGaA, Duesseldorf (DE)

(72) Inventor: Daniel Thomas Piorkowski, Fairfield, CT (US)

(73) Assignee: Henkel AG & Co. KGaA, Duesseldorf (DE)

( * ) Notice: Subject to any disclaimer, the term of this patent is extended or adjusted under 35 U.S.C. 154(b) by 58 days.

(21) Appl. No.: 16/811,347

(22) Filed: Mar. 6, 2020

(65) Prior Publication Data

US 2021/0277332 A1 Sep. 9, 2021

(51) Int. Cl.

| | |
|---|---|
| ***C11D 3/00*** | (2006.01) |
| ***C11D 11/00*** | (2006.01) |
| ***C11D 17/04*** | (2006.01) |
| ***C11D 1/83*** | (2006.01) |
| ***C11D 3/04*** | (2006.01) |
| ***C11D 3/20*** | (2006.01) |
| ***C11D 3/382*** | (2006.01) |
| *C11D 1/22* | (2006.01) |

(52) U.S. Cl.

CPC ..... *C11D 3/0026* (2013.01); *C11D 1/83* (2013.01); *C11D 3/0005* (2013.01); *C11D 3/044* (2013.01); *C11D 3/2048* (2013.01); *C11D 3/2065* (2013.01); *C11D 3/382* (2013.01); *C11D 11/0017* (2013.01); *C11D 17/042* (2013.01); *C11D 1/22* (2013.01)

(58) Field of Classification Search

CPC ..... C11D 3/0026; C11D 11/0017; C11D 17/042; C11D 3/0005

See application file for complete search history.

(56) References Cited

U.S. PATENT DOCUMENTS

| | | | | |
|---|---|---|---|---|
| 5,880,076 A * | 3/1999 | Vermeer | ..... | C11D 3/0089 510/123 |
| 2005/0129643 A1* | 6/2005 | Lepilleur | ..... | A61Q 5/02 424/70.1 |
| 2009/0137438 A1* | 5/2009 | Lepilleur | ..... | C08L 1/26 510/121 |

(Continued)

FOREIGN PATENT DOCUMENTS

| | | | | |
|---|---|---|---|---|
| WO | WO-2013087285 A1 * | 6/2013 | ..... | C11D 3/001 |
| WO | WO-2019166477 A1 * | 9/2019 | | |

*Primary Examiner* — Nicole M. Buie-Hatcher
*Assistant Examiner* — M. Reza Asdjodi
(74) *Attorney, Agent, or Firm* — Bojuan Deng

(57) ABSTRACT

A detergent composition includes a surfactant component including a linear alkylbenzene sulfonate in an amount of from about 10 to about 35 wt % actives, an alkoxylated alcohol in an amount of from about 10 to about 30 wt % actives, water in a total amount of from about 10 to about 27 wt %, sodium and/or potassium hydroxide in an amount of from about 2 to about 4 wt % actives, an acidic defoamer in an amount of from about 1 to about 10 wt % actives, and a filler in an amount of at least about 25 wt % actives. The filler includes (1) propylene glycol, (2) glycerin, and (3) high fructose corn syrup in a weight ratio of actives of about (0 to 0.5):(0 to 0.5):(0.5 to 0.95). The composition includes less than 5 wt % actives of an alcohol ethoxy sulfate and less than 0.1 wt % actives of monoethanolamine.

17 Claims, 6 Drawing Sheets

(56) References Cited

U.S. PATENT DOCUMENTS

| | | | | |
|---|---|---|---|---|
| 2016/0060572 | A1* | 3/2016 | Panandiker | C11D 3/3776 510/327 |
| 2018/0216033 | A1 | 8/2018 | Camire et al. | |
| 2018/0216034 | A1 | 8/2018 | Camire et al. | |
| 2018/0320109 | A1* | 11/2018 | Boutique | C11D 3/43 |
| 2018/0334641 | A1* | 11/2018 | Piorkowski | C11D 1/65 |
| 2019/0112563 | A1* | 4/2019 | Piorkowski | C11D 3/382 |
| 2021/0238500 | A1* | 8/2021 | Piorkowski | C11D 3/001 |
| 2021/0277332 | A1* | 9/2021 | Piorkowski | C11D 17/042 |

* cited by examiner

USE OF FILLER BLEND TO REDUCE TURBIDITY AND DISCOLORATION OF UNIT DOSE DETERGENT COMPOSITION

FIELD OF THE INVENTION

The present disclosure generally relates to a unit dose detergent composition that includes a particular combination of fillers at particular weight ratios of actives which facilitates reduction of turbidity and discoloration. More specifically, this disclosure relates to use of particular weight ratios of actives of propylene glycol, glycerin, and high fructose corn syrup.

BACKGROUND OF THE INVENTION

Some of the cost of producing single dose laundry detergents arises from non-functional solvents, such as glycerin and propylene glycol, and PVOH film. These two classes of materials provide little benefit to the consumer other than maintaining good pac stability (e.g. prevention of leakers, fusions, soft pacs, etc.). However, pac stability can be reduced depending on the type of detergent composition that is used in the pacs.

For example, when High Fructose Corn Syrup (HFCS) 55 is used in compositions, it enables an increase in total water to be achieved and is more cost effective than glycerin and propylene glycol. However, increasing total water can decrease pac stability. Moreover, HFCS 55 is a solid containing liquid (about 72% solid with the solid fraction being about 55% Fructose and about 42% Glucose). When used in traditional compositions, it can participate in an undesirable Maillard browning reaction with can discolor the composition and lead to staining of textiles. Therefore, there remains room for improvement.

In the past, HFCS has been used in applications containing low levels of linear alkylbenzene sulfonate (LAS) (i.e. less than 7.5%) and high levels of alcohol ethoxy sulfate (AES) (about 15.6% active), such as in certain single dose laundry detergents. However, when high levels of AES are used, 1,4 dioxane is also incorporated into the compositions with the AES. In view of potential regulatory restrictions of 1,4 dioxane, eliminating or significantly reducing AES is desirable. Accordingly, LAS can be used to make up for any reduction in AES.

However, high levels of LAS cause more neutralization reactions to occur because LAS is provided in acid form. This means that typical amounts of base used in such compositions can rise 10 fold. This increased use of base increases composition viscosity leading to difficulties in forming and handling pacs, composition turbidity which is indicative of composition instability, and poor product haptics (e.g. pac floppiness). Therefore, there are potential issues associated with using increased amounts of LAS.

Accordingly, there remains an opportunity for improvement. Furthermore, other desirable features and characteristics of the present disclosure will become apparent from the subsequent detailed description of the disclosure and the appended claims, taken in conjunction this background of the disclosure.

SUMMARY OF THE INVENTION

This disclosure provides a unit dose detergent composition having reduced turbidity and discoloration. The detergent composition includes a surfactant component including a linear alkylbenzene sulfonate present in an amount of from about 10 to about 35 weight percent actives based on a total weight of the detergent composition, an alkoxylated alcohol present in an amount of from about 10 to about 30 weight percent actives based on a total weight of the detergent composition, water present in a total amount of from about 10 to about 27 weight percent based on a total weight of the detergent composition, sodium and/or potassium hydroxide present in an amount of from about 2 to about 4 weight percent actives based on a total weight of the detergent composition, an acidic defoamer present in an amount of from about 1 to about 10 weight percent actives based on a total weight of the detergent composition, and a filler present in an amount of at least about 25 weight percent actives based on a total weight of the detergent composition. The filler includes (1) propylene glycol, (2) glycerin, and (3) high fructose corn syrup, wherein (1), (2), and (3) are present in a weight ratio of actives of about (0 to 0.5):(0 to 0.5):(0.5 to 0.95). Moreover, the composition includes less than 5 weight percent actives of an alcohol ethoxy sulfate based on a total weight of the detergent composition and includes less than 0.1 weight percent actives of monoethanolamine based on a total weight of the detergent composition.

This disclosure also provides a unit dose detergent composition having reduced turbidity and discoloration that consists essentially of the aforementioned components. In this embodiment, the composition is free of an alcohol ethoxy sulfate and is free of monoethanolamine.

This disclosure further provides a unit dose detergent pack including a pouch made of a water-soluble film and the detergent composition encapsulated within the pouch.

The detergent composition exhibits superior and unexpected results. More specifically, it was discovered that a particular combination of fillers at particular weight ratios of actives reduces discoloration and turbidity of the detergent composition while simultaneously allowing for the compositions to have excellent water activity which correlates to pac stability and integrity and also to have excellent viscosity which allows for ease of production. Moreover, use of the particular combination of fillers allows for reduction in the use of alcohol ethoxy sulfate (AES) which reduces dioxane incorporation and also allows for reduction or elimination of amines which eliminates a Maillard browning reaction thereby increasing aesthetics and reducing chances of textile staining. Furthermore, the particular combination of fillers allows for stable pacs to be formed that have excellent swelling percentages which correlate to pac feel and that have excellent spring constant values which correlated to pac and film integrity.

BRIEF DESCRIPTION OF THE DRAWINGS

The present disclosure will hereinafter be described in conjunction with the following Figures, wherein.

(i) (0.13):(0.08):(0.78);

(ii) (0.15):(0.17):(0.68); and (iii) (0.05):(0.15):(0.5); and

Figure 2A:
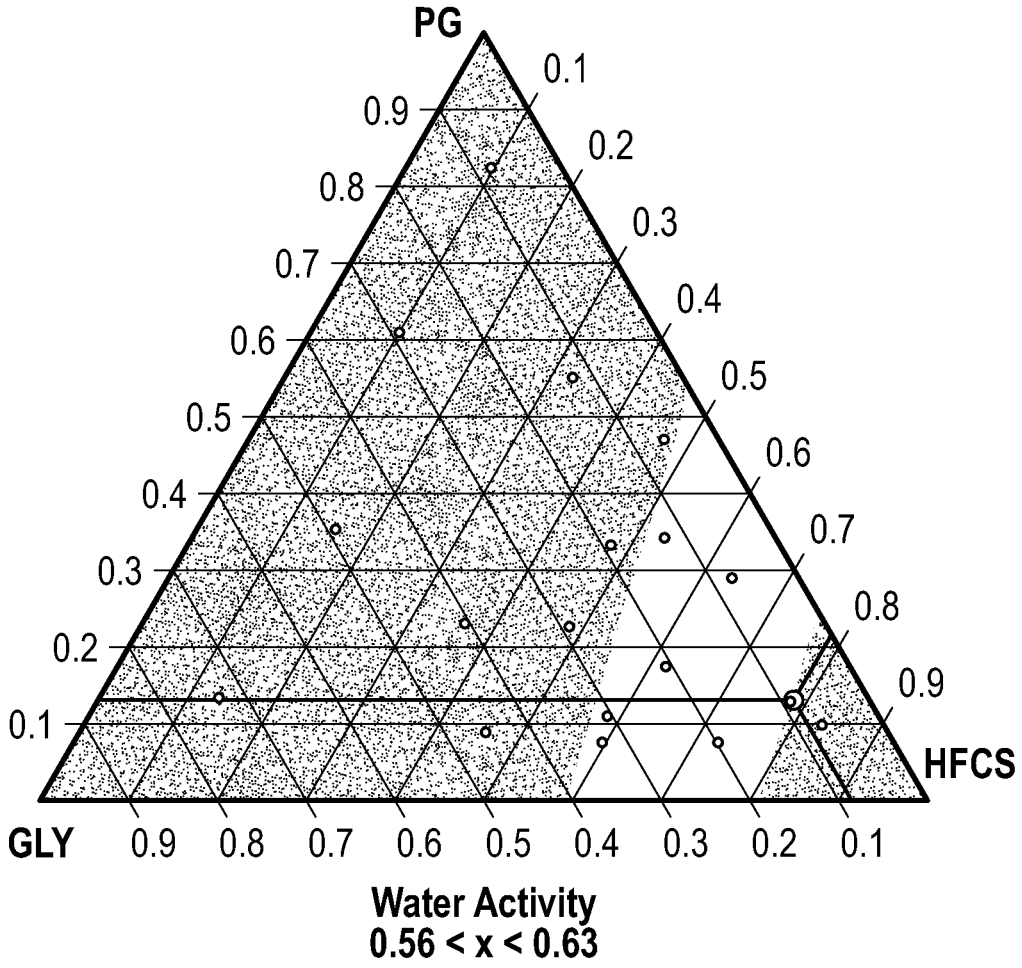
Figure 2B:
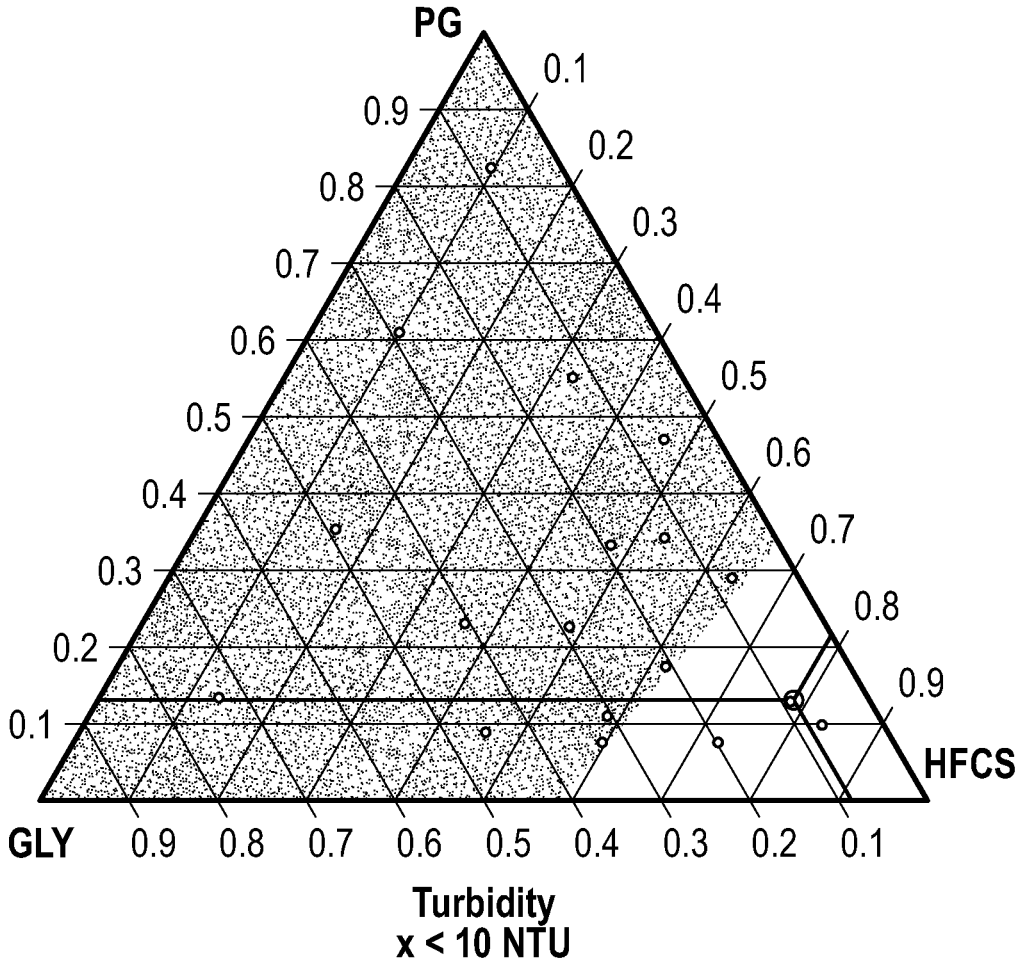
Figure 2C:
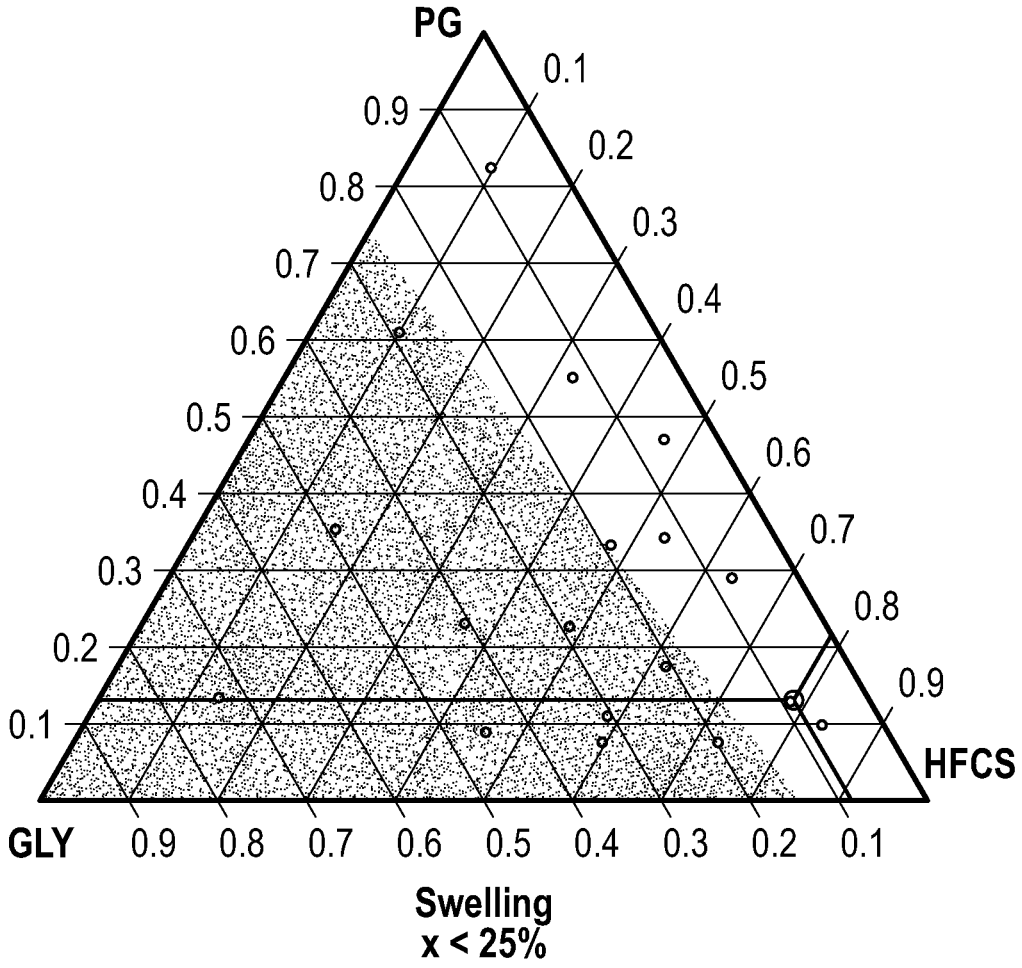
Figure 2D:
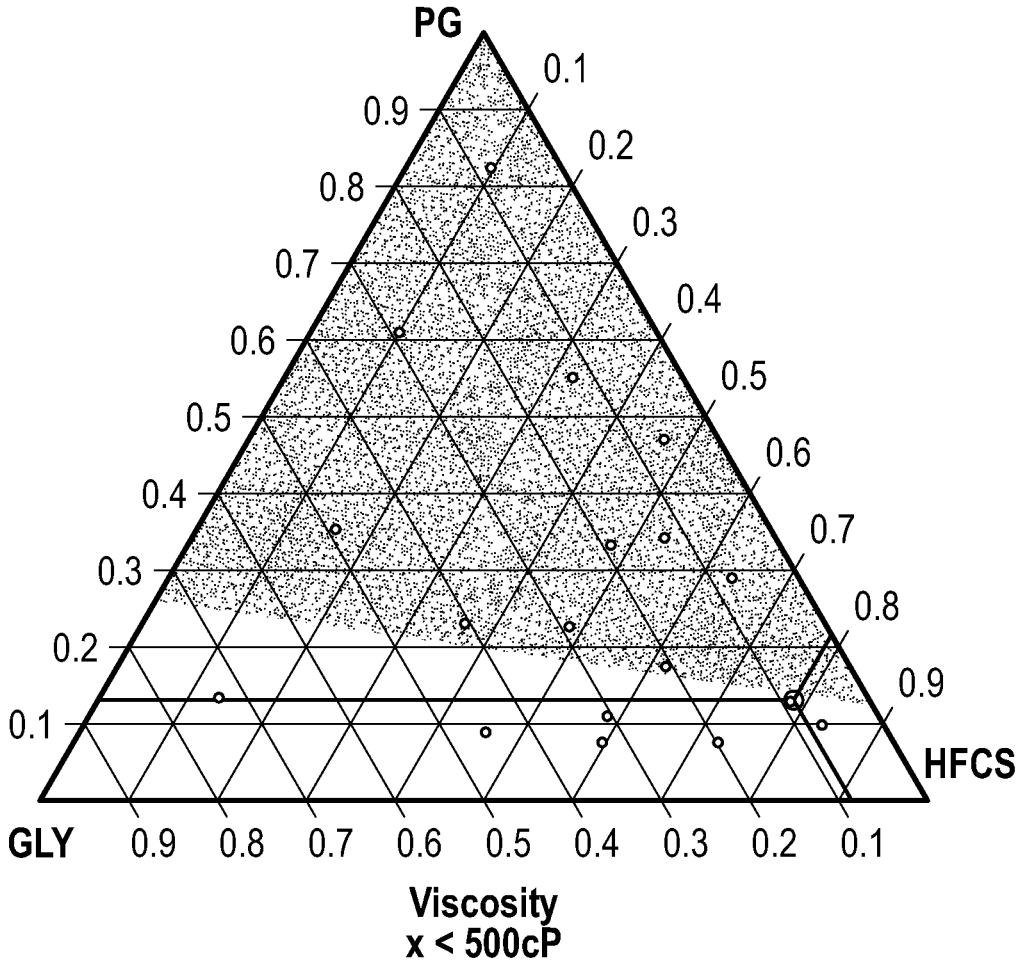

FIGS. 2A-E are a series of ternary plots of weight ratios of actives of three fillers of various embodiments of the instant disclosure relative to Propylene Glycol (PG); Glycerin (G), and High Fructose Corn Syrup 55 (HFCS55) as set forth in the Examples wherein:

Water Activity ($0.56<x<0.63$ at 25° C.) as determined using the following algorithm generated from the Examples:

Water Activity=0.445*PG+0.371*G+0.690*HFCS55 FIG. 2A;

Turbidity ($x<10$ NTU at 25° C.) as determined using the following algorithm generated from the Examples:

Turbidity=1478.82*PG+1042.08*Gly+negative 732.68*HFCS55 FIG. 2B;

Swelling % ($x<25\%$) as determined using the following algorithm generated from the Examples:

Swelling=19.39*PG+41.13*Gly+22.33*HFCS55 FIG. 2C;

Viscosity ($x<500$ cp at 70° F.) as determined using the following algorithm generated from the Examples:

Viscosity=6411.31*PG+negative 1565.43*Gly+negative 325.33*HFCS55 FIG. 2D; and

Figure 2E:
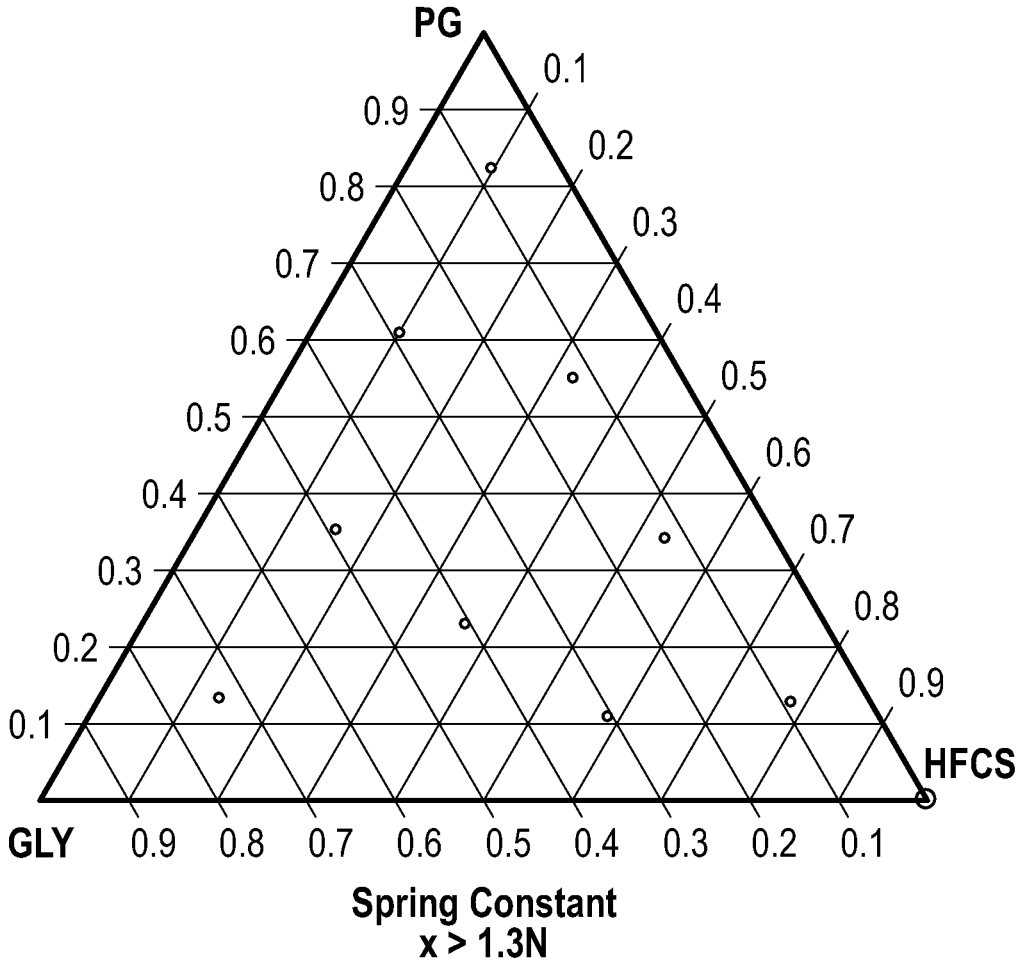

Spring Constant ($x>1.3$N) as determined using the following algorithm generated from the Examples:

Spring Constant=2.76*PG+2.04*Gly+2.58*HFCS55 FIG. 2E.

DETAILED DESCRIPTION OF THE INVENTION

The following detailed description is merely exemplary in nature and is not intended to limit the disclosure. Furthermore, there is no intention to be bound by any theory presented in the preceding background or the following detailed description.

Embodiments of the present disclosure are generally directed to detergent compositions and methods for forming the same. For the sake of brevity, conventional techniques related to detergent compositions may not be described in detail herein. Moreover, the various tasks and process steps described herein may be incorporated into a more comprehensive procedure or process having additional steps or functionality not described in detail herein. In particular, various steps in the manufacture of detergent compositions are well-known and so, in the interest of brevity, many conventional steps will only be mentioned briefly herein or will be omitted entirely without providing the well-known process details.

Detergent Composition

This disclosure provides a unit dose detergent composition having reduced turbidity and discoloration. The detergent composition includes a surfactant component including a linear alkylbenzene sulfonate present in an amount of from about 10 to about 35 weight percent actives based on a total weight of the detergent composition, an alkoxylated alcohol present in an amount of from about 10 to about 30 weight percent actives based on a total weight of the detergent composition, water present in a total amount of from about 10 to about 27 weight percent based on a total weight of the detergent composition, sodium and/or potassium hydroxide present in an amount of from about 2 to about 4 weight percent actives based on a total weight of the detergent composition, an acidic defoamer present in an amount of from about 1 to about 10 weight percent actives based on a total weight of the detergent composition, and a filler present in an amount of at least about 25 weight percent actives based on a total weight of the detergent composition. The filler includes (1) propylene glycol, (2) glycerin, and (3) high fructose corn syrup, wherein (1), (2), and (3) are present in a weight ratio of actives of about (0 to 0.5):(0 to 0.5):(0.5 to 0.95). Moreover, the composition includes less than 0.1 weight percent actives of an alcohol ethoxy sulfate based on a total weight of the detergent composition and includes less than 5 weight percent actives of monoethanolamine based on a total weight of the detergent composition.

In one embodiment, the detergent composition consists essentially of the aforementioned components.

In another embodiment, the detergent composition consists of the aforementioned components.

In another embodiment, the detergent composition consists essentially of the linear alkylbenzene sulfonate present in an amount of from about 20 to about 25 weight percent actives based on a total weight of the detergent composition; the alkoxylated alcohol that is a C12-C15 alcohol ethoxylate that is capped with about 7 moles of ethylene oxide and is present in an amount of from about 20 to about 25 weight percent actives based on a total weight of the detergent composition; the water present in a total amount of from about 10 to about 15 weight percent based on a total weight of the detergent composition; the sodium hydroxide present in an amount of from about 2 to about 4 weight percent actives based on a total weight of the detergent composition; the acidic defoamer that is a coconut fatty acid and is present in an amount of from about 2 to about 4 weight percent actives based on a total weight of the detergent composition; the filler present in an amount of from about 40 to about 45 weight percent actives based on a total weight of the detergent composition; and the high fructose corn syrup that is high fructose corn syrup 55, wherein the detergent composition is free of an alcohol ethoxy sulfate having a $C_8$-$C_{20}$ backbone that is ethoxylated with from about 1 to about 10 moles of ethylene oxide and is free of monoethanolamine, and wherein the detergent composition has a water activity of from about 0.56 to about 0.63 measured at 25° C.; a turbidity of less than about 10 NTU measured at 25° C.; and a viscosity of less than about 500 cp as determined at 20 rpm using an LV02 (62) spindle with a Brookfield Viscometer (DV2T) at 70° F.

In still another embodiment, the detergent composition consists essentially of a surfactant component including a linear alkylbenzene sulfonate present in an amount of from about 10 to about 35 weight percent actives based on a total weight of the detergent composition; and an alkoxylated alcohol present in an amount of from about 10 to about 30 weight percent actives based on a total weight of the detergent composition; water present in a total amount of from about 10 to about 27 weight percent based on a total weight of the detergent composition; sodium and/or potassium hydroxide present in an amount of from about 2 to about 4 weight percent actives based on a total weight of the detergent composition; an acidic defoamer present in an amount of from about 1 to about 10 weight percent actives based on a total weight of the detergent composition; and a filler present in an amount of at least about 25 weight percent actives based on a total weight of the detergent composition, wherein the filler includes (1) propylene glycol; (2) glycerin; and (3) high fructose corn syrup; wherein (1), (2), and (3) are present in a weight ratio of actives of about (0 to 0.5):(0 to 0.5):(0.5 to 0.95); wherein the composition is free of an alcohol ethoxy sulfate; and wherein the composition is free of monoethanolamine.

The detergent composition exhibits superior and unexpected results. More specifically, it was discovered that a particular combination of fillers at particular weight ratios of actives reduces discoloration and turbidity of the detergent composition while simultaneously allowing for the compositions to have excellent water activity which correlates to pac stability and integrity and also to have excellent viscosity which allows for ease of production. Moreover, use of the particular combination of fillers allows for reduction in the use of AES which reduces dioxane incorporation and also allows for reduction or elimination of amines which eliminates a Maillard browning reaction thereby increasing aesthetics and reducing chances of textile staining. Furthermore, the particular combination of fillers allows for stable pacs to be formed that have excellent swelling percentages which correlate to pac feel and that have excellent spring constant values which correlated to pac and film integrity.

Surfactant Component

As first introduced above, the composition includes the surfactant component. The surfactant component includes, is, consists essentially of, or consists of, a linear alkylbenzene sulfonate and an alkoxylated alcohol. The linear alkylbenzene sulfonate is present in an amount of from about 10 to about 35 weight percent actives based on a total weight of the detergent composition. The alkoxylated alcohol is present in an amount of from about 10 to about 30 weight percent actives based on a total weight of the detergent composition.

In one embodiment, the surfactant component includes the linear alkylbenzene sulfonate that is present in an amount of from about 10 to about 35 weight percent actives based on a total weight of the detergent composition and the alkoxylated alcohol that is present in an amount of from about 10 to about 30 weight percent actives based on a total weight of the detergent composition.

In another embodiment, the surfactant component consists essentially of the linear alkylbenzene sulfonate that is present in an amount of from about 10 to about 35 weight percent actives based on a total weight of the detergent composition and the alkoxylated alcohol that is present in an amount of from about 10 to about 30 weight percent actives based on a total weight of the detergent composition.

In one embodiment, the surfactant component consists of the linear alkylbenzene sulfonate that is present in an amount of from about 10 to about 35 weight percent actives based on a total weight of the detergent composition and the alkoxylated alcohol that is present in an amount of from about 10 to about 30 weight percent actives based on a total weight of the detergent composition.

Linear Alkylbenzene Sulfonate (LAS)

The linear alkylbenzene sulfonate (LAS) may have a linear alkyl chain that has, e.g. 10 to 13 carbon atoms. These carbon atoms are present in approximately the following mole ratios C10:C11:C12:C13 is about 13:30:33:24 having an average carbon number of about 11.6 and a content of the most hydrophobic 2-phenyl isomers of about 18-29 wt %. The linear alkylbenzene sulfonate may be any known in the art. In various non-limiting embodiments, all values, both whole and fractional, between and including all of the above, are hereby expressly contemplated for use herein.

In one embodiment, the alcohol ethoxy sulfate is sodium laureth sulfate ethoxylated with about 2 to about 4 moles of ethylene oxide, the linear alkyl benzenesulfonate has a linear alkyl chain that has from about 10 to about 13 carbon atoms, and the alkoxylated alcohol is an ethoxylated alcohol including a $C_8$-$C_{20}$ backbone that is ethoxylated with from about 2 to about 12 moles of ethylene oxide.

The linear alkylbenzene sulfonate is present in an amount of from about 10 to about 35 weight percent actives based on a total weight of the detergent composition. In various embodiments, the linear alkylbenzene sulfonate is present in an amount of from about 10 to about 30, about 10 to about 25, about 10 to about 20, about 10 to about 15, about 15 to about 35, about 15 to about 30, about 15 to about 25, about 15 to about 20, about 20 to about 35, about 20 to about 30, about 20 to about 25, about 25 to about 35, about 25 to about 30, about 30 to about 35, or about 10, 15, 20, 25, 30, or 35, weight percent actives based on a total weight of the detergent composition. In other embodiments, the linear alkylbenzene sulfonate is present in an amount of from about 18 to about 25, about 19 to about 24, about 20 to about 24, about 21 to about 23, about 22 to about 23, or about 18, 19, 20, 21, 22, 23, 24, or 25, weight percent actives based on a total weight of the surfactant component. In various non-limiting embodiments, all values, both whole and fractional, between and including all of the above, are hereby expressly contemplated for use herein.

Alkoxylated Alcohol:

The alkoxylated alcohol may be a $C_8$-$C_{20}$ alcohol that is capped with (or includes) approximately 2 to 12 moles of an alkylene oxide. In other embodiments, the alkoxylated alcohol may be an alcohol alkoxylate that has from 8 to 20, 10 to 18, 12 to 16, or 12 to 14, carbon atoms and is an ethoxylate, propoxylate, or butoxylate and is capped with an alkylene oxide, e.g. ethylene oxide, propylene oxide, or butylene oxide. The alkoxylated alcohol may be capped with varying numbers of moles of the alkylene oxide, e.g. about 2 to about 12, about 3 to about 11, about 4 to about 10, about 5 to about 9, about 6 to about 8, or about 7 to about 8, moles. In various non-limiting embodiments, all values, both whole and fractional, between and including all of the above, are hereby expressly contemplated for use herein.

The alkoxylated alcohol is present in an amount of from about 10 to about 30 weight percent actives based on a total weight of the detergent composition. In various embodiments, the alkoxylated alcohol is present in an amount of from about 10 to about 25, about 10 to about 20, about 10 to about 15, about 15 to about 30, about 15 to about 25, about 15 to about 20, about 20 to about 30, about 20 to about 25, about 25 to about 30, or about 10, 15, 20, 25, or 30, weight percent actives based on a total weight of the detergent composition. In other embodiments, the alkoxylated alcohol is present in an amount of from about 18 to about 28, about 19 to about 27, about 20 to about 26, about 21 to about 25, about 22 to about 24, about 22 to about 23, or about 18, 19, 20, 21, 22, 23, 24, 25, 26, 27 or 28, weight percent actives based on a total weight of the surfactant component. In various non-limiting embodiments, all values, both whole and fractional, between and including all of the above, are hereby expressly contemplated for use herein.

Water

The detergent composition also includes water. Water is present in the composition in a total amount of from about 10 to about 27 weight percent based on a total weight of the composition. In various embodiments, the water is present in an amount of from about 10 to about 25, about 10 to about 20, about 10 to about 15, about 15 to about 27, about 15 to about 25, about 15 to about 20, about 20 to about 27, about 20 to about 25, or about 10, 15, 20, 25, or 27, weight percent based on a total weight of the composition. Typically, the terminology "total amount" refers to a total amount of water present in the composition from all components, i.e., not simply water added independently from, for example, the surfactant component. In various non-limiting embodiments, all values, both whole and fractional, between and including all of the above, are hereby expressly contemplated for use herein.

An independent source of water, such as DI water, may be used to dilute the composition. This water may be independent from any water present in the composition as originating from one or more components. In other words, the composition includes water originating from the components themselves. However, to further dilute the composition, the independent water source may be used.

Sodium and/or Potassium Hydroxide

The detergent composition also includes sodium and/or potassium hydroxide. The sodium and/or potassium hydroxide is present in an amount of from about 2 to about 4, about 2 to about 3, or about 3 to about 4, weight percent actives based on a total weight of the composition. In various non-limiting embodiments, all values, both whole and fractional, between and including all of the above, are hereby expressly contemplated for use herein.

In one embodiment, the detergent composition includes sodium hydroxide present in an amount of from about 2 to about 4, about 2 to about 3, or about 3 to about 4, weight percent actives based on a total weight of the composition. In various non-limiting embodiments, all values, both whole and fractional, between and including all of the above, are hereby expressly contemplated for use herein.

In another embodiment, the detergent composition includes potassium hydroxide present in an amount of from about 2 to about 4, about 2 to about 3, or about 3 to about 4, weight percent actives based on a total weight of the composition. In various non-limiting embodiments, all values, both whole and fractional, between and including all of the above, are hereby expressly contemplated for use herein.

It is contemplated that sodium hydroxide may be used to the exclusion of potassium hydroxide or potassium hydroxide may be used to the exclusion of sodium hydroxide, or both may be used together.

It is also contemplated that the detergent composition may include less than 5, 4, 3, 2, 1, 0.5, or 0.1, or be entirely free of, one or more salts including, but not limited to, Group IIA hydroxides, Group IA salts apart from the aforementioned hydroxides, Group IIA salts, transition metal salts, amine salts, etc. In various non-limiting embodiments, all values and ranges of values, both whole and fractional, between and including all of the above, are hereby expressly contemplated herein.

Acidic Defoamer

The composition also includes an acidic defoamer, foam inhibitor, or defoaming agent. Suitable acidic defoamers include, but are not limited to, fatty acids such as coconut fatty acids, long chain fatty alcohols, fatty acid soaps or esters, or combinations thereof. In one embodiment, the acidic defoamer is a coconut fatty acid. In other embodiments, the acidic defoamer is chosen from tall oil fatty acids, coco fatty acids, oleic acids, and combinations thereof. In other embodiments, the acidic defoamer is chosen from fatty acids, fatty acid salts, fatty acid amides, fatty acid alcohols, fatty acid amines, and combinations thereof.

The acidic defoamer is present in an amount of from about 1 to about 10, about 2 to about 9, about 3 to about 8, about 4 to about 7, about 5 to about 6, about 2 to about 4, about 2 to about 4, about 3 to about 4, or about 1, 2, 3, 4, 5, 6, 7, 8, 9, or 10, weight percent actives based on a total weight of the composition. In various non-limiting embodiments, all values and ranges of values, both whole and fractional, between and including all of the above, are hereby expressly contemplated herein.

Filler

The composition also includes the filler present in an amount of at least 25 weight percent actives based on a total weight of the composition. In various embodiments, the filler is present in an amount of from about 25 to about 77, about 25 to about 75, about 25 to about 70, about 25 to about 65, about 25 to about 60, about 25 to about 55, about 25 to about 50, about 25 to about 45, about 25 to about 40, about 25 to about 35, about 25 to about 30, about 30 to about 75, about 30 to about 70, about 30 to about 65, about 30 to about 60, about 30 to about 55, about 30 to about 55, about 30 to about 50, about 30 to about 45, about 30 to about 40, about 30 to about 35, about 35 to about 75, about 35 to about 70, about 35 to about 65, about 35 to about 60, about 35 to about 55, about 35 to about 50, about 35 to about 45, about 35 to about 40, about 40 to about 75, about 40 to about 70, about 40 to about 65, about 40 to about 60, about 40 to about 55, about 40 to about 55, about 40 to about 50, about 40 to about 45, about 45 to about 75, about 45 to about 70, about 45 to about 65, about 45 to about 60, about 45 to about 55, about 45 to about 50, about 50 to about 75, about 50 to about 70, about 50 to about 65, about 50 to about 60, about 50 to about 55, about 55 to about 75, about 55 to about 70, about 55 to about 65, about 55 to about 60, about 60 to about 75, about 60 to about 70, about 60 to about 65, about 65 to about 75, about 65 to about 70, or about 70 to about 75, weight percent actives based on a total weight of the composition. In various non-limiting embodiments, all values and ranges of values, both whole and fractional, between and including all of the above, are hereby expressly contemplated herein.

The filler includes (1) propylene glycol, (2) glycerin, and (3) high fructose corn syrup, wherein (1), (2), and (3) are present in a weight ratio of actives of about (0 to 0.5):(0 to 0.5):(0.5 to 0.95).

For example, the propylene glycol may be present in any weight ratio of about 0 to about 0.5, about 0.05 to about 0.45, about 0.1 to about 0.4, about 0.15 to about 0.35, about 0.2 to about 0.3, about 0.25 to about 0.3, or about 0.05, 0.1, 0.15, 0.2, 0.25, 0.3, 0.35, 0.4, 0.45, or 0.5. In various non-limiting embodiments, all values and ranges of values, both whole and fractional, between and including all of the above, are hereby expressly contemplated herein.

The glycerin may be present in any weight ratio of about 0 to about 0.5, about 0.05 to about 0.45, about 0.1 to about 0.4, about 0.15 to about 0.35, about 0.2 to about 0.3, about 0.25 to about 0.3, or about 0.05, 0.1, 0.15, 0.2, 0.25, 0.3, 0.35, 0.4, 0.45, or 0.5. In various non-limiting embodiments, all values and ranges of values, both whole and fractional, between and including all of the above, are hereby expressly contemplated herein.

The high fructose corn syrup may be present in any weight ratio of about 0.5 to about 0.95, about 0.55 to about 0.9, about 0.6 to about 0.85, about 0.65 to about 0.8, about 0.7 to about 0.75, or about 0.5, 0.55, 0.6, 0.65, 0.7, 0.75, 0.8, 0.85, 0.9, or 0.95. In various non-limiting embodiments, all values and ranges of values, both whole and fractional, between and including all of the above, are hereby expressly contemplated herein.

In another embodiment, (1), (2), and (3) are present in a weight ratio of actives of about (0.05 to 0.15):(0.08 to 0.17):(0.5 to 0.78).

For example, the propylene glycol may be present in any weight ratio of about 0.05 to 0.15, about 0.05 to 0.1, about 0.1 to about 0.15, or about 0.05, 0.06, 0.07, 0.08, 0.09, 0.1, 0.11, 0.12, 0.13, 0.14, or 0.15. In various non-limiting embodiments, all values and ranges of values, both whole and fractional, between and including all of the above, are hereby expressly contemplated herein.

The glycerin may be present in any weight ratio of about 0.08 to about 0.17, about 0.08 to about 0.12, about 0.12 to about 0.17, about 0.1 to about 0.15, or about 0.08, 0.09, 0.1, 0.11, 0.12, 0.13, 0.14, 0.15, 0.16, or 0.17. In various non-limiting embodiments, all values and ranges of values, both whole and fractional, between and including all of the above, are hereby expressly contemplated herein.

The high fructose corn syrup may be present in any weight ratio of about 0.5 to about 0.78, about 0.55 to about 0.75, about 0.6 to about 0.7, about 0.65 to about 0.7, or about 0.5, 0.55, 0.6, 0.65, 0.7, 0.75, or 0.78. In various non-limiting embodiments, all values and ranges of values, both whole and fractional, between and including all of the above, are hereby expressly contemplated herein.

Figure 1:
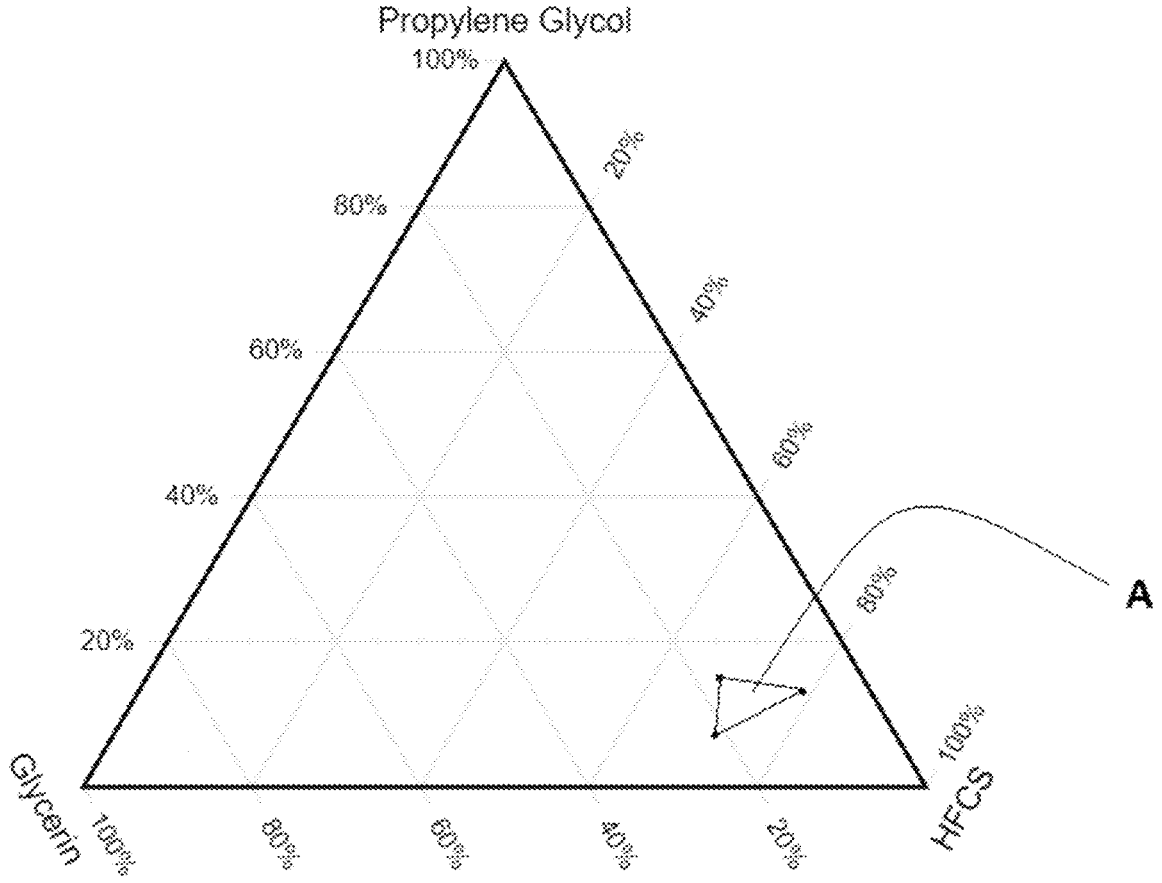
FIG. 1 is a ternary plot of weight ratios of actives of three fillers of various embodiments of the instant disclosure showing a three-sided region (A) that is further described in the Examples and that is defined by three points of the ratio (1) propylene glycol:(2) glycerin:(3) high fructose corn syrup as set forth in the Examples and as follows.

In various embodiments, the weight ratio of actives of (1), (2), and (3) falls within a three-sided region (A) of a ternary plot, wherein the three-sided region (A) is defined by three points of the ratio of (1):(2):(3) as follows:

(i) (0.13):(0.08):(0.78);

(ii) (0.15):(0.17):(0.68); and (iii) (0.05):(0.15):(0.5), for example, as shown in FIG. 1. All values of the weight ratio of actives of (1), (2), and (3) within the three-sided region (A) defined above are expressly contemplated herein in various non-limiting embodiments. In various non-limiting embodiments, all values and ranges of values, both whole and fractional, between and including all of the above, are hereby expressly contemplated herein.

Referring back to the high fructose corn syrup (HFCS), it is not particularly limited and may be any known in the art. HFCS includes about 24 wt % water, about 5 to about 5 wt % glucose oligomers, and the balance of fructose and glucose. For example, the HFCS may be further defined as HFCS 42, HFCS 55, HFCS 65, HFCS 70, HFCS 90, or combinations thereof. The aforementioned numerical values refer to an approximate weight percent of fructose, e.g. HFCS 42 includes approximately 42 wt % fructose. Any of these may be utilized in the instant disclosure. Similarly, any type or version of glycerin and/or propylene glycol may be used in the instant disclosure.

Alcohol Ethoxy Sulfate (AES) and/or Monoethanolamine

In various embodiments, the surfactant component, and the detergent composition as a whole, includes less than 5, 4, 3, 2, 1, 0.5, 0.1, 0.05, or 0.01, weight percent actives of an alcohol ethoxy sulfate (AES) and/or monoethanolamine, based on a total weight of the composition. Typically, the surfactant component, and the detergent composition as a whole, includes less than 0.1, weight percent actives, of monoethanolamine, based on a total weight of the composition. In other embodiments, the surfactant component, and the detergent composition as a whole, is free of the alcohol ethoxy sulfate and/or monoethanolamine. In various non-limiting embodiments, all values and ranges of values, both whole and fractional, between and including all of the above, are hereby expressly contemplated herein. Typically, monoethanolamine is excluded in this technology because it reacts with reducing sugars of fructose and glycose in a Maillard browning reaction which undesirably adds brown, black, or burnt color to the surfactant components and/or detergent composition.

For example, the alcohol ethoxy sulfate that is present in an amount of less than 5, 4, 3, 2, 1, 0.5, 0.1, 0.05, or 0.01, weight percent actives based on a total weight of the composition, or that is excluded from the composition altogether, may be described as follows. The alcohol ethoxy sulfate may have a $C_8$-$C_{20}$ backbone that is ethoxylated with from about 1 to about 10 moles of ethylene oxide. The backbone may have any number of carbon atoms from 8 to 20, e.g. 10 to 18, 12 to 16, 12 to 14, 14 to 16, or 8, 9, 10, 11, 12, 13, 14, 15, 16, 17, 18, 19, or 20, carbon atoms. The backbone may be ethoxylated with from about 1 to about 10, about 2 to about 9, about 3 to about 8, about 4 to about 7, about 5 to about 6, or 1, 2, 3, 4, 5, 6, 7, 8, 9, or 10, moles of ethylene oxide. In various embodiments, the alcohol ethoxy sulfate is further defined as sodium laureth sulfate (SLES) having the formula: $CH_3(CH_2)_{10}CH_2(OCH_2CH_2)_n OSO_3Na$ wherein n is from about 1 to about 10. In another embodiment, the alcohol ethoxy sulfate is sodium laureth sulfate ethoxylated with about 2 to about 4 moles of ethylene oxide. In various non-limiting embodiments, all values and ranges of values, both whole and fractional, between and including all of the above, are hereby expressly contemplated herein.

Additional Surfactants

In other embodiments, one or more additional surfactants may be utilized or may be expressly excluded from the composition. These one or more additional surfactants may be or include cationic, anionic, non-ionic, and/or zwitterionic surfactants, and/or combinations thereof. Additional anionic surfactants may include soaps which contain sulfate or sulfonate groups, including those with alkali metal ions as cations, can be used. Usable soaps include alkali metal salts of saturated or unsaturated fatty acids with 12 to 18 carbon (C) atoms. Such fatty acids may also be used in incompletely neutralized form. Usable ionic surfactants of the sulfate type include the salts of sulfuric acid semi esters of fatty alcohols with 12 to 18 C atoms. Usable ionic surfactants of the sulfonate type include alkane sulfonates with 12 to 18 C atoms and olefin sulfonates with 12 to 18 C atoms, such as those that arise from the reaction of corresponding monoolefins with sulfur trioxide, alpha-sulfofatty acid esters such as those that arise from the sulfonation of fatty acid methyl or ethyl esters. In various non-limiting embodiments, all values, both whole and fractional, between and including all of the above, are hereby expressly contemplated for use herein.

Other suitable examples of additional nonionic surfactants include alkyl glycosides and ethoxylation and/or propoxylation products of alkyl glycosides or linear or branched alcohols in each case having 12 to 18 carbon atoms in the alkyl moiety and 3 to 20, or 4 to 10, alkyl ether groups. Corresponding ethoxylation and/or propoxylation products of N-alkylamines, vicinal diols, and fatty acid amides, which correspond to the alkyl moiety in the stated long-chain alcohol derivatives, may furthermore be used. Alkylphenols having 5 to 12 carbon atoms may also be used in the alkyl moiety of the above described long-chain alcohol derivatives. In various non-limiting embodiments, all values, both whole and fractional, between and including all of the above, are hereby expressly contemplated for use herein.

In other embodiments, the additional surfactant is chosen from nonionic and ionic surfactants, such as alkoxylates, polyglycerols, glycol ethers, glycols, polyethylene glycols, polypropylene glycols, polybutylene glycols, glycerol ester ethoxylates, polysorbates, alkyl ether sulfates, alkyl- and/or arylsulfonates, alkyl sulfates, ester sulfonates (sulfo-fatty acid esters), ligninsulfonates, fatty acid cyanamides, anionic sulfosuccinic acid surfactants, fatty acid isethionates, acylaminoalkane-sulfonates (fatty acid taurides), fatty acid sarcosinates, ether carboxylic acids and alkyl(ether)phosphates. In such embodiments, suitable nonionic surfactants include $C_2$-$C_6$-alkylene glycols and poly-$C_2$-$C_3$-alkylene glycol ethers, optionally, etherified on one side with a $C_1$-$C_6$-alkanol and having, on average, 1 to 9 identical or different, typically identical, alkylene glycol groups per molecule, and also alcohols and fatty alcohol polyglycol ethers, typically propylene glycol, dipropylene glycol, trimethylolpropane, and fatty alcohols with low degrees of ethoxylation having 6 to 22, typically 8 to 18, more typically 8 to 12, and even more typically 8 to 11, carbon atoms. Moreover, suitable ionic surfactants include alkyl ether sulfates, sulfosuccinic acid surfactants, polyacrylates and phosphonic acids, typically lauryl sulfate, lauryl ether sulfate, sodium sulfosuccinic acid diisooctyl ester, 1-hydroxyethane-1,1-diphosphonic acid, and diacetyltartaric esters. In various non-limiting embodiments, all values, both whole and fractional, between and including all of the above, are hereby expressly contemplated for use herein.

The one or more additional surfactants may be part of the surfactant component, as described above, or may be independent from the surfactant component. In various embodiments, the one or more additional surfactants is or includes an additional anionic surfactant and/or a non-ionic surfactant. However, other surfactants such as cationic and/or zwitterionic (amphoteric) surfactants may also be utilized or may be excluded from the composition.

The one or more additional surfactants may be present in any amount, e.g. in any of the amounts described above for any other surfactant. Alternatively, the one or more additional surfactants may be present in any amount described below relative to the additives.

Additives

The composition may include, or be free of, one or more additives. Such additives include, but are not limited to, those described below.

Bittering agents may optionally be added to hinder accidental ingestion of the composition. Bittering agents are compositions that taste bad, so children or others are discouraged from accidental ingestion. Exemplary bittering agents include denatonium benzoate, aloin, and others. Bittering agents may be present in the composition at an amount of from about 0 to about 1 weight percent, or an amount of from about 0 to about 0.5 weight percent, or an amount of from about 0 to about 0.1 weight percent in various embodiments, based on the total weight of the composition. In various non-limiting embodiments, all values, both whole and fractional, between and including all of the above, are hereby expressly contemplated for use herein.

In other embodiments, additives may be or include enzymes, optical brighteners, chelators, and combinations thereof. These additives may be chosen from any known in the art.

In one embodiment, the composition is free of, or includes less than 5, 4, 3, 2, 1, 0.5, or 0.1, weight percent of, a solvent other than water, e.g. an organic solvent, non-polar solvent, polar aprotic solvent, polar protic solvent, etc. and combinations thereof. In various non-limiting embodiments, all values, both whole and fractional, between and including all of the above, are hereby expressly contemplated for use herein.

Method of Forming the Detergent Composition

This disclosure also provides a method of forming the detergent composition. The method may include the step of combining any one or more of the aforementioned components with any one or more of the other aforementioned components to form the composition. The components may be combined in one or multiple parts and all orders of addition are hereby expressly contemplated. Moreover, the addition may be batch or continuous.

Unit Dose Detergent Pack

This disclosure also provides a unit dose detergent pack that includes a pouch made of a water-soluble film and the detergent composition encapsulated within the pouch. The detergent composition may be any described above.

A unit dose pack can be formed by encapsulating the detergent composition within the pouch, wherein the pouch includes a film. In some embodiments, the film forms one half or more of the pouch, where the pouch may also include dyes or other components. In some embodiments, the film is water soluble such that the film will completely dissolve when an exterior of the film is exposed to water, such as in a washing machine typically used for laundry. When the film dissolves, the pouch is ruptured and the contents are released. As used herein, "water soluble" means at least 2 grams of the solute (the film in one example) will dissolve in 5 liters of solvent (water in one example) for a solubility of at least 0.4 grams per liter (g/l), at a temperature of 25 degrees Celsius (° C.) unless otherwise specified. Suitable films for packaging are completely soluble in water at temperatures of about 5° C. or greater.

In various embodiments, the film is desirably strong, flexible, shock resistant, and non-tacky during storage at both high and low temperatures and high and low humidities. In one embodiment, the film is initially formed from polyvinyl acetate, and at least a portion of the acetate functional groups are hydrolyzed to produce alcohol groups. The film may include polyvinyl alcohol (PVOH), and may include a higher concentration of PVOH than polyvinyl acetate. Such films are commercially available with various levels of hydrolysis, and thus various concentrations of PVOH, and in an exemplary embodiment the film initially has about 85 percent of the acetate groups hydrolyzed to alcohol groups. Some of the acetate groups may further hydrolyze in use, so the final concentration of alcohol groups may be higher than the concentration at the time of packaging. The film may have a thickness of from about 25 to about 200 microns (μm), or from about 45 to about 100 μm, or from about 70 to about 90 μm in various embodiments. The film may include alternate materials in some embodiments, such as methyl hydroxy propyl cellulose and polyethylene oxide. In various non-limiting embodiments, all values, both whole and fractional, between and including all of the above, are hereby expressly contemplated for use herein.

The unit dose pack may be formed from a pouch having a single section, but the unit dose pack may be formed from pouches with two or more different sections in alternate embodiments. In embodiments with a pouch having two or more sections, the contents of the different sections may or may not be the same.

In one embodiment, a unit dose detergent pack includes a pouch made of a water-soluble film and a detergent composition encapsulated within the pouch, wherein the detergent composition includes: a surfactant component including; a linear alkylbenzene sulfonate present in an amount of from about 10 to about 35 weight percent actives based on a total weight of the detergent composition; and an alkoxylated alcohol present in an amount of from about 10 to about 30 weight percent actives based on a total weight of the detergent composition; water present in a total amount of from about 10 to about 27 weight percent based on a total weight of the detergent composition; sodium and/or potassium hydroxide present in an amount of from about 2 to about 4 weight percent actives based on a total weight of the detergent composition; an acidic defoamer present in an amount of from about 1 to about 10 weight percent actives based on a total weight of the detergent composition; and a filler present in an amount of at least about 25 weight percent actives based on a total weight of the detergent composition, wherein the filler includes; (1)propylene glycol; (2) glycerin; and (3) high fructose corn syrup; wherein (1), (2), and (3) are present in a weight ratio of actives of about (0 to 0.5):(0 to 0.5):(0.5 to 0.95); wherein the composition includes less than 5 weight percent actives of an alcohol ethoxy sulfate based on a total weight of the detergent composition; and wherein the composition includes less than 0.1 weight percent actives of monoethanolamine based on a total weight of the detergent composition.

In a related embodiment, the linear alkylbenzene sulfonate is present in an amount of from about 20 to about 25 weight percent actives based on a total weight of the detergent composition; the alkoxylated alcohol is a C12-C15 alcohol ethoxylate that is capped with about 7 moles of ethylene oxide and is present in an amount of from about 20 to about 25 weight percent actives based on a total weight of the detergent composition; the water is present in a total amount of from about 10 to about 15 weight percent based on a total weight of the detergent composition; the sodium hydroxide is present in an amount of from about 2 to about 4 weight percent actives based on a total weight of the detergent composition; the acidic defoamer is a coconut fatty acid and is present in an amount of from about 2 to about 4 weight percent actives based on a total weight of the detergent composition; the filler is present in an amount of from about 40 to about 45 weight percent actives based on a total weight of the detergent composition; and the high fructose corn syrup includes about 55 weight percent fructose, and the detergent composition is free of an alcohol ethoxy sulfate having a $C_8$-$C_{20}$ backbone that is ethoxylated with from about 1 to about 10 moles of ethylene oxide, and the detergent composition is free of monoethanolamine.

Method of Forming Unit Dose Pack

This disclosure also provides a method of forming the unit dose pack. The detergent composition is typically first formed, e.g. using shear mixing. Shear mixing may be conducted using an over-the-head mixer such as an IKA RW 20 Digital Mixer at 500 rpm. The composition may then be encapsulated within a pouch by depositing the composition within the pouch. The pouch may then be sealed to encase and enclose the composition within the pouch to form the unit dose pack. The composition is typically in direct contact with the film of the pouch within the unit dose pack. The film of the pouch is typically sealable by heat, heat and water, ultrasonic methods, or other techniques, and one or more sealing techniques may be used to enclose the composition within the pouch.

Physical Properties of Composition and Unit Dose Detergent Pack

The composition and unit dose detergent pack are not particularly limited relative to physical properties.

However, in various embodiments, the composition has a water activity of from about 0.56 to about 0.63 measured at 25° C. In various embodiments, the water activity may be from about 0.57 to about 0.62, about 0.58 to about 0.61, about 0.59 to about 0.60, or about 0.56, 0.57, 0.58, 0.59, 0.6, 0.61, 0.62, or 0.63. In various non-limiting embodiments, all values and ranges of values, both whole and fractional, between and including all of the above, are hereby expressly contemplated herein.

Water activity is typically measured at 25° C. with an Aqua Lab 4TEV DUO (water activity meter) on the capacitance setting. The water activity of an aqueous composition is defined as the partial pressure of water in the aqueous composition divided by the saturation pressure of water at the temperature of the aqueous composition. If no temperature is specified, the default temperature is room temperature. The water activity can be determined by placing a sample in a container which is then sealed, and after equilibrium is reached, determining the relative humidity above the sample. The water activity is calculated from the equilibrium relative humidity according to the following equation: Water activity (Aw)=(Equilibrium relative humidity)/100. Various water activities contemplated herein are shown in FIG. 2A.

Moreover, Water Activity (0.56<x<0.63 at 25° C.) can be determined using the following algorithm as generated from the data shown in FIG. 2A.

$$\text{Water Activity}=0.445*PG+0.371*G+0.690*HFCS55$$

wherein PG=propylene glycol; G=glycerin; and HFCS55=high fructose corn syrup 55.

In various embodiments, the composition has a turbidity of less than about 10, 9, 8, 7, 6, 5, 4, 3, 2, or 1, NTU measured at 25° C. For example, the turbidity may be from about 1 to about 10, about 2 to about 9, about 3 to about 8, about 4 to about 7, about 5 to about 6, or about 1, 2, 3, 4, 5, 6, 7, 8, 9, or 10. In various non-limiting embodiments, all values and ranges of values, both whole and fractional, between and including all of the above, are hereby expressly contemplated herein.

Turbidity is typically measured with a HACH Turbidity Meter (model 2100N) at 25° C. by placing liquid inside of sample vials and inserting into the instrument. The instrument then calculates the NTU (Turbidity Units) of each formula. Various turbidities contemplated herein are shown in FIG. 2B.

Moreover, Turbidity (x<10 NTU at 25° C.) can be determined using the following algorithm as generated from the data shown in FIG. 2B.

$$\text{Turbidity}=1478.82*PG+1042.08*Gly+\text{negative } 732.68*HFCS55$$

wherein PG=propylene glycol; G=glycerin; and HFCS55=high fructose corn syrup 55.

In various embodiments, the composition has a viscosity of less than about 500 cp as determined at 20 rpm using an LV02 (62) spindle with a Brookfield Viscometer (DV2T) at 70° F. For example, the composition may have a viscosity of less than about 500, 475, 450, 400, 375, 350, 325, 300, 275, 250, 225, 200, 175, 150, 125, 100, 75, 50, or 25, cp as determined at 20 rpm using an LV02 (62) spindle with a Brookfield Viscometer (DV2T) at 70° F. In other embodiments, the composition may have a viscosity of any one of the aforementioned values or from about 25 to about 500, about 50 to about 475, about 75 to about 450, about 100 to about 425, about 125 to about 400, about 150 to about 375, about 175 to about 350, about 200 to about 325, about 225 to about 300, or about 250 to about 275, cp as determined at 20 rpm using an LV02 (62) spindle with a Brookfield Viscometer (DV2T) at 70° F. In various non-limiting embodiments, all values and ranges of values, both whole and fractional, between and including all of the above, are hereby expressly contemplated herein.

Moreover, Viscosity (x<500 cp at 70° F.) can be determined using the following algorithm as generated from the data shown in FIG. 2D.

$$\text{Viscosity}=6411.31*PG+\text{negative } 1565.43*Gly+\text{negative } 325.33*HFCS55$$

wherein PG=propylene glycol; G=glycerin; and HFCS55=high fructose corn syrup 55.

The viscosity of the composition, e.g. those described above, may be measured using various techniques. For example, the viscosity may be measured using a Brookfield viscometer and any one or more spindles, as is chosen by one of skill in the art. In various embodiments, the composition has one or more of the aforementioned viscosities measured using a DV2T Brookfield viscometer at 20 rpm and 70° F. using spindle LV02(62). Alternatively, the viscosity may be described as being measured using a rheometer, e.g. any known in the art. In various embodiments, the composition has one or more of the aforementioned viscosities measured using an AR2000-EX Rheometer at a shear rate of 1.08 l/s at 75° F. with a geometry cone of 40 mm, 1:59:49 degree:min:sec, and a truncation gap of 52 microns. However, the shear rate, temperature, geometry cone, values for degree:min:sec, and truncation gap may all vary and be chosen by one of skill in the art.

Moreover, the composition may have reduced discoloration and may have a color of light straw or yellow, as understood by those of skill in the art. The composition may be transparent or approximately transparent and non-turbid, not cloudy, and not opaque. Typically, the composition is not brown, black, or burnt in appearance and does not have the color of motor oil. The darker undesirable colors typically result from a Maillard reaction of monoethanolamine and the reducing sugars of fructose and glucose which produce dark colored bodies which may stain textiles and other surfaces.

Referring now to the unit dose detergent pack, this pack may have a swelling ratio of less than about 25, 20, 15, 10, or 5, %. In various non-limiting embodiments, all values and ranges of values, both whole and fractional, between and including all of the above, are hereby expressly contemplated herein.

The swelling ratio is determined using three 1"×3" strips of PVOH film that are weighed individually. The strips are then arranged in a 10 cm diameter petri dish and test liquid is poured over the strips until completely submerged. The lid is placed on the dish, and the system is allowed to equilibrate for approximately 24 hours at about 70° F. The strips are then removed from the dish, and excess liquid is wiped off using kimwipes. The strips are then re-weighed. The swelling ratio is s=(final weight−initial weight)/initial weight.

Moreover, swelling ratio (%) (x<25%) can be determined using the following algorithm as generated from the data set forth in FIG. 2C.

$$\text{Swelling}=19.39*PG+41.13*Gly+22.33*HFCS55$$

wherein PG=propylene glycol; G=glycerin; and HFCS55=high fructose corn syrup 55.

The pack may alternatively have a spring constant of greater than about 1.3, 1.34, 1.4, 1.45, 1.5, N, etc. The spring constant is determined using three 1"×3" strips of PVOH film that are arranged in a 10 cm diameter petri dish. Test liquid is poured over the strips until completely submerged. The lid is placed on the dish, and the system is allowed to equilibrate for approximately 24 hours at about 70° F. The strips are then removed from the dish, and excess liquid is wiped off using kimwipes. The strips are then individually loaded onto a Tinius Olsen HSKT tensometer equipped with a 250N load cell and pneumatic grips positioned 1.5" apart. The strips then undergo three 2 mm stretches, and the force/distance curve is recorded for each stretch. The slope (in N/mm) is recorded for each stretch. The average slope of all curves generated is the value reported.

Moreover, Spring Constant (x>1.3N) can be determined using the following algorithm as generated from the data set forth in FIG. 2E.

$$\text{Spring Constant}=2.76*PG+2.04*Gly+2.58*HFCS55$$

wherein PG=propylene glycol; G=glycerin; and HFCS55=high fructose corn syrup 55.

Additional Embodiments

In one embodiment, the linear alkylbenzene sulfonate is present in an amount of from about 20 to about 25 weight percent actives based on a total weight of the detergent composition; the alkoxylated alcohol is a C12-C15 alcohol ethoxylate that is capped with about 7 moles of ethylene oxide and is present in an amount of from about 20 to about 25 weight percent actives based on a total weight of the detergent composition; the water is present in a total amount of from about 10 to about 15 weight percent based on a total weight of the detergent composition; the sodium hydroxide is present in an amount of from about 2 to about 4 weight percent actives based on a total weight of the detergent composition; the acidic defoamer is a coconut fatty acid and is present in an amount of from about 2 to about 4 weight percent actives based on a total weight of the detergent composition; the filler is present in an amount of from about 40 to about 45 weight percent actives based on a total weight of the detergent composition; the high fructose corn syrup is high fructose corn syrup 55, the detergent composition is free of an alcohol ethoxy sulfate having a $C_8$-$C_{20}$ backbone that is ethoxylated with from about 1 to about 10 moles of ethylene oxide, and the detergent composition is free of monoethanolamine.

In another embodiment, the weight ratio of actives of (1), (2), and (3) falls within a three-sided region (A) of a ternary plot, wherein the three-sided region (A) is defined by three points of the ratio of (1):(2):(3) as follows:

(i) (0.13):(0.08):(0.78);

(ii) (0.15):(0.17):(0.68); and (iii) (0.05):(0.15):(0.5), and the detergent consists essentially of: the linear alkylbenzene sulfonate present in an amount of from about 20 to about 25 weight percent actives based on a total weight of the detergent composition; the alkoxylated alcohol that is a C12-C15 alcohol ethoxylate that is capped with about 7 moles of ethylene oxide and is present in an amount of from about 20 to about 25 weight percent actives based on a total weight of the detergent composition; the water present in a total amount of from about 10 to about 15 weight percent based on a total weight of the detergent composition; the sodium hydroxide present in an amount of from about 2 to about 4 weight percent actives based on a total weight of the detergent composition; the acidic defoamer that is a coconut fatty acid and is present in an amount of from about 2 to about 4 weight percent actives based on a total weight of the detergent composition; the filler present in an amount of from about 40 to about 45 weight percent actives based on a total weight of the detergent composition; and the high fructose corn syrup that is high fructose corn syrup 55, wherein the detergent composition is free of an alcohol ethoxy sulfate having a $C_8$-$C_{20}$ backbone that is ethoxylated with from about 1 to about 10 moles of ethylene oxide and is free of monoethanolamine, and wherein the detergent composition has a water activity of from about 0.56 to about 0.63 measured at 25° C.; a turbidity of less than about 10 NTU measured at 25° C.; and a viscosity of less than about 500 cp as determined at 20 rpm using an LV02 (62) spindle with a Brookfield Viscometer (DV2T) at 70° F.

In still another embodiment, a unit dose detergent composition having reduced turbidity and discoloration consists essentially of a surfactant component including a linear alkylbenzene sulfonate present in an amount of from about 10 to about 35 weight percent actives based on a total weight of the detergent composition; and an alkoxylated alcohol present in an amount of from about 10 to about 30 weight percent actives based on a total weight of the detergent composition; water present in a total amount of from about 10 to about 27 weight percent based on a total weight of the detergent composition; sodium and/or potassium hydroxide present in an amount of from about 2 to about 4 weight percent actives based on a total weight of the detergent composition; an acidic defoamer present in an amount of from about 1 to about 10 weight percent actives based on a total weight of the detergent composition; and a filler present in an amount of at least about 25 weight percent actives based on a total weight of the detergent composition, wherein the filler includes; (1) propylene glycol; (2) glycerin; and (3) high fructose corn syrup; wherein (1), (2), and (3) are present in a weight ratio of actives of about (0 to 0.5):(0 to 0.5):(0.5 to 0.95); wherein the composition is free of an alcohol ethoxy sulfate; and wherein the composition is free of monoethanolamine.

EXAMPLES

Example 1

The following Design of Experiment was used to measure the effect of particular fillers on water activity, viscosity, and turbidity of various detergent compositions and swelling ratio (%) and spring constant of pacs that include the various detergent composition. The values generated from these measurements were also utilized to generate the aforementioned algorithms.

More specifically, a design of experiment was based off the following formulation base (contains no solvent):

| Description | Wt % |
|---|---|
| Glycerin | — |
| Propylene Glycol | — |
| 25-7 Alcohol Ethoxylate | 22.185 |
| Tinopal CBS-X | 0.200 |
| Sodium Hydroxide (50%) | 6.941 |
| LAS | 22.203 |
| Coconut Fatty Acid | 3.000 |
| HFCS 55 | — |
| Bitrex | 0.050 |
| Zeolite Water | 3.500 |

-continued

| Description | Wt % |
|---|---|
| Total Water | 7.099 |
| Subtotal | 58.079 |

25-7 Alcohol Ethoxylate is a C12-C15 Alcohol Ethoxylate that is capped with approximately 7 moles of ethylene oxide.

Linear Alkylbenzene Sulfonic Acid is 2-Phenyl Sulfonic Acid.

The Table below sets forth ratios of active levels of various fillers of Compositions 1-18. These correspond to various points set forth in the ternary plots of the FIGS. 1 and 2. More specifically, this Design of Experiment varied the use level (1) propylene glycol, (2) glycerin, and (3) high fructose corn syrup. These fillers were varied at the following ratios of solvents (which were added into the base to fill in the 41.921 hole, such that the formulation adds to 100):

| | (1) Propylene Glycol | (2) Glycerin | (3) High Fructose Corn Syrup 55 |
|---|---|---|---|
| Composition 1 | 0.13 | 0.73 | 0.14 |
| Composition 2 | 0.55 | 0.12 | 0.33 |
| Composition 3 | 0.11 | 0.31 | 0.59 |
| Composition 4 | 0.61 | 0.29 | 0.10 |
| Composition 5 | 0.34 | 0.13 | 0.54 |
| Composition 6 | 0.35 | 0.49 | 0.16 |
| Composition 7 | 0.13 | 0.09 | 0.78 |
| Composition 8 | 0.23 | 0.41 | 0.37 |
| Composition 9 | 0.82 | 0.08 | 0.10 |
| Composition 10 | 0.33 | 0.19 | 0.48 |
| Composition 11 | 0.07 | 0.33 | 0.60 |
| Composition 12 | 0.17 | 0.21 | 0.62 |
| Composition 13 | 0.10 | 0.07 | 0.83 |
| Composition 14 | 0.09 | 0.45 | 0.46 |
| Composition 15 | 0.07 | 0.20 | 0.73 |
| Composition 16 | 0.29 | 0.08 | 0.64 |
| Composition 17 | 0.47 | 0.06 | 0.47 |
| Composition 18 | 0.23 | 0.29 | 0.48 |

After formation, the aforementioned Compositions 1-18 were evaluated to determine water activity, viscosity, and turbidity and swelling ratio (%) and spring constant of pacs that include the various detergent composition. The values generated from these measurements were also utilized to generate the aforementioned algorithms of FIGS. 2A-2E.

| Composition | Water Activity | Turbidity (NTU) | Swelling Ratio (%) | Viscosity (cP) | Spring Constant (N) |
|---|---|---|---|---|---|
| Composition 1 | 0.42 | 570 | 34.68 | 943 | 2.3 |
| Composition 2 | 0.52 | 750 | 26.13 | 508 | 2.57 |
| Composition 3 | 0.58 | 5 | 26.12 | 1175 | 2.44 |
| Composition 4 | 0.45 | 1770 | 26.13 | 385 | 2.28 |
| Composition 5 | 0.57 | 5 | 23.62 | 643 | 2.5 |
| Composition 6 | 0.45 | 1410 | 31.55 | 601 | 2.31 |
| Composition 7 | 0.62 | 5 | 23.23 | 1208 | 2.58 |
| Composition 8 | 0.5 | 70 | 30.68 | 856 | 2.47 |
| Composition 9 | 0.46 | 720 | 18.9 | 9486 | 2.92 |
| Composition 10 | 0.5445 | 5 | 20.2 | 615 | Not Measured |
| Composition 11 | 0.5693 | 5 | 21.02 | 1282 | Not Measured |
| Composition 12 | 0.585 | 5 | 20.81 | 932 | Not Measured |
| Composition 13 | 0.6358 | 5 | 21.61 | 2162 | Not Measured |
| Composition 14 | 0.5291 | 5 | 23.56 | 1140 | Not Measured |
| Composition 15 | 0.6057 | 5 | 23.96 | 1704 | Not Measured |
| Composition 16 | 0.5868 | 5 | 18.23 | 753 | Not Measured |
| Composition 17 | 0.5485 | 314 | 21 | 528 | Not Measured |
| Composition 18 | 0.5384 | 5 | 24.33 | 816 | Not Measured |

After the data was generated, the data was plotted on the various ternary plots of FIGS. 2A-E. These ternary plots were then combined to form the ternary plot of FIG. 1 and to define the three-sided region (A) that satisfies all of the aforementioned conditions.

FIG. 2A is a ternary plot of weight ratios of actives of Propylene Glycol (PG); Glycerin (G), and High Fructose Corn Syrup 55 (HFCS55) that shows the water activity data points set forth above and that is shaded to correspond to the requirements of: Water Activity (0.56<x<0.63 at 25° C.).

FIG. 2B is a ternary plot of the aforementioned actives that shows the turbidity data points set forth above and that is shaded to correspond to the requirements of: Turbidity (x<10 NTU at 25° C.).

FIG. 2C is a ternary plot of the aforementioned actives that shows the swelling data points set forth above and that is shaded to correspond to the requirements of: Swelling % (x<25%).

FIG. 2D is a ternary plot of the aforementioned actives that shows the viscosity data points set forth above and that is shaded to correspond to the requirements of Viscosity (x<500 cp at 70° F.).

FIG. 2E is a ternary plot of the aforementioned actives that shows the spring constant data points set forth above and that is shaded to correspond to the requirements of: Spring Constant (x>1.3N).

More specifically, the aforementioned data was used to generate the following algorithms using JMP software well known to those of skill in the art:

Water Activity (0.56<x<0.63 at 25° C.) as determined using the following algorithm:

$$\text{Water Activity}=0.445*PG+0.371*G+0.690*HFCS55 \quad \text{(FIG. 2A)}$$

Turbidity (x<10 NTU at 25° C.) as determined using the following algorithm:

$$\text{Turbidity}=1478.82*PG+1042.08*Gly+\text{negative } 732.68*HFCS55 \quad \text{(FIG. 2B)}$$

Swelling % (x<25%) as determined using the following algorithm:

$$\text{Swelling}=19.39*PG+41.13*Gly+22.33*HFCS55 \quad \text{(FIG. 2C)}$$

Viscosity (x<500 cp at 70° F.) as determined using the following algorithm:

$$\text{Viscosity}=6411.31*PG+\text{negative } 1565.43*Gly+\text{negative } 325.33*HFCS55 \quad \text{(FIG. 2D)}$$

Spring Constant (x>1.3N) as determined using the following algorithm:

$$\text{Spring Constant}=2.76*PG+2.04*Gly+2.58*HFCS55 \quad \text{(FIG. 2E)}$$

The data set forth above demonstrates that the detergent composition exhibits superior and unexpected results. More specifically, it was discovered that a particular combination of fillers at particular weight ratios of actives reduces discoloration and turbidity of the detergent composition while simultaneously allowing for the compositions to have excellent water activity which correlates to pac stability and integrity and also to have excellent viscosity which allows for ease of production. Moreover, use of the particular combination of fillers allows for reduction in the use of AES which reduces dioxane incorporation and also allows for reduction or elimination of amines which eliminates a Maillard browning reaction thereby increasing aesthetics and reducing chances of textile staining. Furthermore, the particular combination of fillers allows for stable pacs to be formed that have excellent swelling percentages which correlate to pac feel and that have excellent spring constant values which correlated to pac and film integrity.

By increasing an amount of LAS in a composition, a type of composition is formed that requires up to 10 or more times an amount of neutralizing agent (such as NaOH) than is typically required. Although seemingly straightforward, such a composition is unexpectedly turbid and unstable. This limits a formulator's ability to create a stable, effective, and aesthetically pleasing product for the consumer. Accordingly, the solution set forth herein is also surprising and unexpected and is superior to what is known to those of skill in the art.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration in any way. Rather, the foregoing detailed description will provide those skilled in the art with a convenient road map for implementing an exemplary embodiment. It being understood that various changes may be made in the function and arrangement of elements described in an exemplary embodiment without departing from the scope as set forth in the appended claims.

What is claimed is:

1. A unit dose detergent composition having reduced turbidity and discoloration, said detergent composition comprising:

A. a surfactant component comprising:

a linear alkylbenzene sulfonate present in an amount of from about 10 to about 35 weight percent actives based on a total weight of said detergent composition; and an alkoxylated alcohol present in an amount of from about 10 to about 30 weight percent actives based on a total weight of said detergent composition;

B. water present in a total amount of from about 10 to about 27 weight percent based on a total weight of said detergent composition;

C. sodium and/or potassium hydroxide present in an amount of from about 2 to about 4 weight percent actives based on a total weight of said detergent composition;

D. an acidic defoamer present in an amount of from about 1 to about 10 weight percent actives based on a total weight of said detergent composition; and E. a filler present in an amount of at least about 25 weight percent actives based on a total weight of said detergent composition, wherein said filler comprises;

(1) propylene glycol;

(2) glycerin; and (3) high fructose corn syrup;

wherein said composition comprises less than 5 weight percent actives of an alcohol ethoxy sulfate based on a total weight of said detergent composition;

wherein said composition comprises less than 0.1 weight percent actives of monoethanolamine based on a total weight of said detergent composition; and wherein (1), (2), and (3) fall within a three-sided region (A) of a ternary plot, wherein the three-sided region (A) is defined by three points of the ratio of (1):(2):(3) as follows:

(i) (0.13):(0.08):(0.78);

(ii) (0.15):(0.17):(0.68); and (0.07):(0.21):(0.72).

2. The detergent composition of claim 1 wherein high fructose corn syrup is high fructose corn syrup 55.

3. The detergent composition of claim 2 wherein said filler is present in an amount of from about 40 to about 65 weight percent actives based on a total weight of said detergent composition.

4. The detergent composition of claim 3 wherein said linear alkylbenzene sulfonate is present in an amount of from about 18 to about 25 weight percent actives based on a total weight of said surfactant component.

5. The detergent composition of claim 4 wherein said alkoxylated alcohol is a C12-C15 alcohol ethoxylate that is capped with about 7 moles of ethylene oxide and is present in an amount of from about 18 to about 28 weight percent actives based on a total weight of said surfactant component.

6. The detergent composition of claim 5 wherein said acidic defoamer is present in an amount of from about 2 to about 4 weight percent actives based on a total weight of said detergent composition.

7. The detergent composition of claim 6 that is free of an alcohol ethoxy sulfate having a $C_8$-$C_{20}$ backbone that is ethoxylated with from about 1 to about 10 moles of ethylene oxide and is free of monoethanolamine.

8. The detergent composition of claim 1 wherein:

said linear alkylbenzene sulfonate is present in an amount of from about 20 to about 25 weight percent actives based on a total weight of said detergent composition;

said alkoxylated alcohol is a C12-C15 alcohol ethoxylate that is capped with about 7 moles of ethylene oxide and is present in an amount of from about 20 to about 25 weight percent actives based on a total weight of said detergent composition;

said water is present in a total amount of from about 10 to about 15 weight percent based on a total weight of said detergent composition;

said sodium hydroxide is present in an amount of from about 2 to about 4 weight percent actives based on a total weight of said detergent composition;

said acidic defoamer is a coconut fatty acid and is present in an amount of from about 2 to about 4 weight percent actives based on a total weight of said detergent composition;

said filler is present in an amount of from about 40 to about 45 weight percent actives based on a total weight of said detergent composition;

said high fructose corn syrup is high fructose corn syrup 55, said detergent composition is free of an alcohol ethoxy sulfate having a $C_8$-$C_{20}$ backbone that is ethoxylated with from about 1 to about 10 moles of ethylene oxide, and said detergent composition is free of monoethanolamine.

9. The detergent composition of claim 8 having:

a water activity of from about 0.56 to about 0.63 measured at 25° C.;

a turbidity of less than about 10 NTU measured at 25° C.; and a viscosity of less than about 500 cp as determined at 20 rpm using an LV02 (62) spindle with a Brookfield Viscometer (DV2T) at 70° F.

10. The detergent composition of claim 1 consisting essentially of:

said linear alkylbenzene sulfonate present in an amount of from about 20 to about 25 weight percent actives based on a total weight of said detergent composition;

said alkoxylated alcohol that is a C12-C15 alcohol ethoxylate that is capped with about 7 moles of ethylene oxide and is present in an amount of from about 20 to about 25 weight percent actives based on a total weight of said detergent composition;

said water present in a total amount of from about 10 to about 15 weight percent based on a total weight of said detergent composition;

said sodium hydroxide present in an amount of from about 2 to about 4 weight percent actives based on a total weight of said detergent composition;

said acidic defoamer that is a coconut fatty acid and is present in an amount of from about 2 to about 4 weight percent actives based on a total weight of said detergent composition;

said filler present in an amount of from about 40 to about 45 weight percent actives based on a total weight of said detergent composition; and said high fructose corn syrup that is high fructose corn syrup 55, wherein said detergent composition is free of an alcohol ethoxy sulfate having a $C_8$-$C_{20}$ backbone that is ethoxylated with from about 1 to about 10 moles of ethylene oxide and is free of monoethanolamine, and wherein said detergent composition has a water activity of from about 0.56 to about 0.63 measured at 25° C.; a turbidity of less than about 10 NTU measured at 25° C.; and a viscosity of less than about 500 cp as determined at 20 rpm using an LV02 (62) spindle with a Brookfield Viscometer (DV2T) at 70° F.

11. The detergent composition of claim 1 having:

a water activity of from about 0.56 to about 0.63 measured at 25° C.;

a turbidity of less than about 10 NTU measured at 25° C.; and a viscosity of less than about 500 cp as determined at 20 rpm using an LV02 (62) spindle with a Brookfield Viscometer (DV2T) at 70° F.

12. The detergent composition of claim 1 that is free of an alcohol ethoxy sulfate having a $C_8$-$C_{20}$ backbone that is ethoxylated with from about 1 to about 10 moles of ethylene oxide and is free of monoethanolamine.

13. A unit dose detergent composition having reduced turbidity and discoloration, said detergent composition consisting essentially of:

A. a surfactant component comprising;

a linear alkylbenzene sulfonate present in an amount of from about 10 to about 35 weight percent actives based on a total weight of said detergent composition; and an alkoxylated alcohol present in an amount of from about 10 to about 30 weight percent actives based on a total weight of said detergent composition;

B. water present in a total amount of from about 10 to about 27 weight percent based on a total weight of said detergent composition;

C. sodium and/or potassium hydroxide present in an amount of from about 2 to about 4 weight percent actives based on a total weight of said detergent composition;

D. an acidic defoamer present in an amount of from about 1 to about 10 weight percent actives based on a total weight of said detergent composition; and E. a filler present in an amount of at least about 25 weight percent actives based on a total weight of said detergent composition, wherein said filler comprises;

(1) propylene glycol;

(2) glycerin; and (3) high fructose corn syrup;

wherein said composition is free of an alcohol ethoxy sulfate;

wherein said composition is free of monoethanolamine; and wherein (1), (2), and (3) fall within a three-sided region (A) of a ternary plot, wherein the three-sided region (A) is defined by three points of the ratio of (1):(2):(3) as follows:

(i) (0.13):(0.08):(0.78);

(ii) (0.15):(0.17):(0.68); and (0.07):(0.21):(0.72).

14. A unit dose detergent pack comprising a pouch made of a water-soluble film and a detergent composition encapsulated within said pouch, wherein said detergent composition comprises:

A. a surfactant component comprising;

a linear alkylbenzene sulfonate present in an amount of from about 10 to about 35 weight percent actives based on a total weight of said detergent composition; and an alkoxylated alcohol present in an amount of from about 10 to about 30 weight percent actives based on a total weight of said detergent composition;

B. water present in a total amount of from about 10 to about 27 weight percent based on a total weight of said detergent composition;

C. sodium and/or potassium hydroxide present in an amount of from about 2 to about 4 weight percent actives based on a total weight of said detergent composition;

D. an acidic defoamer present in an amount of from about 1 to about 10 weight percent actives based on a total weight of said detergent composition; and E. a filler present in an amount of at least about 25 weight percent actives based on a total weight of said detergent composition, wherein said filler comprises;

(1) propylene glycol;

(2) glycerin; and (3) high fructose corn syrup;

wherein said composition comprises less than 5 weight percent actives of an alcohol ethoxy sulfate based on a total weight of said detergent composition;

wherein said composition comprises less than 0.1 weight percent actives of monoethanolamine based on a total weight of said detergent composition; and wherein (1), (2), and (3) fall within a three-sided region (A) of a ternary plot, wherein the three-sided region (A) is defined by three points of the ratio of (1):(2):(3) as follows:

(i) (0.13):(0.08):(0.78);

(ii) (0.15):(0.17):(0.68); and (0.07):(0.21):(0.72).

15. The unit dose detergent pack of claim 14 wherein:

said linear alkylbenzene sulfonate is present in an amount of from about 20 to about 25 weight percent actives based on a total weight of said detergent composition;

said alkoxylated alcohol is a C12-C15 alcohol ethoxylate that is capped with about 7 moles of ethylene oxide and is present in an amount of from about 20 to about 25 weight percent actives based on a total weight of said detergent composition;

said water is present in a total amount of from about 10 to about 15 weight percent based on a total weight of said detergent composition;

said sodium hydroxide is present in an amount of from about 2 to about 4 weight percent actives based on a total weight of said detergent composition;

said acidic defoamer is a coconut fatty acid and is present in an amount of from about 2 to about 4 weight percent actives based on a total weight of said detergent composition;

said filler is present in an amount of from about 40 to about 45 weight percent actives based on a total weight of said detergent composition; and said high fructose corn syrup comprises about 55 weight percent fructose, and said detergent composition is free of an alcohol ethoxy sulfate having a $C_8$-$C_{20}$ backbone that is ethoxylated with from about 1 to about 10 moles of ethylene oxide, and said detergent composition is free of monoethanolamine.

16. The unit dose detergent pack of claim 15 that exhibits:

a swelling ratio of less than about 25% determined as a percent increase in mass versus time zero; and a spring constant of greater than 1.3N.

17. The unit dose detergent pack of claim 14 wherein said detergent composition is free of an alcohol ethoxy sulfate having a $C_8$-$C_{20}$ backbone that is ethoxylated with from about 1 to about 10 moles of ethylene oxide and is free of monoethanolamine.

* * * * *